United States Patent [19]

Paglia

[11] 4,403,117

[45] Sep. 6, 1983

[54] SONIC TRANSDUCER HAVING DIAPHRAGM TENSIONING SPRING DIRECTLY ATTACHED TO DIAPHRAGM

[75] Inventor: Richard Paglia, Carlisle, Mass.

[73] Assignee: Polaroid Corporation, Cambridge, Mass.

[21] Appl. No.: 270,400

[22] Filed: Jun. 4, 1981

[51] Int. Cl.[3] ..... H04R 19/00

[52] U.S. Cl. ..... 179/111 R

[58] Field of Search ..... 179/111 R, 111 E, 106; 181/158, 171

[56] References Cited

U.S. PATENT DOCUMENTS 3,373,251 3/1968 Seefer ..... 179/111 R 4,085,297 4/1978 Paglia ..... 179/111 R

*Primary Examiner*—Stafford D. Schreyer

*Attorney, Agent, or Firm*—John J. Kelleher

[57] ABSTRACT

Method and apparatus for significantly reducing the size and cost of an electroacoustical transducer. The transducer assembly includes a backplate with a grooved electrically conductive surface and a spring whose center portion supports the center portion of said backplate. The vibratile diaphragm of said transducer cooperatively engages said grooved backplate surface and the periphery of said diaphragm is bonded to a peripheral extension of said spring while said spring is being compressed under a predetermined amount of spring-flexing force.

17 Claims, 10 Drawing Figures

FIG. 4A
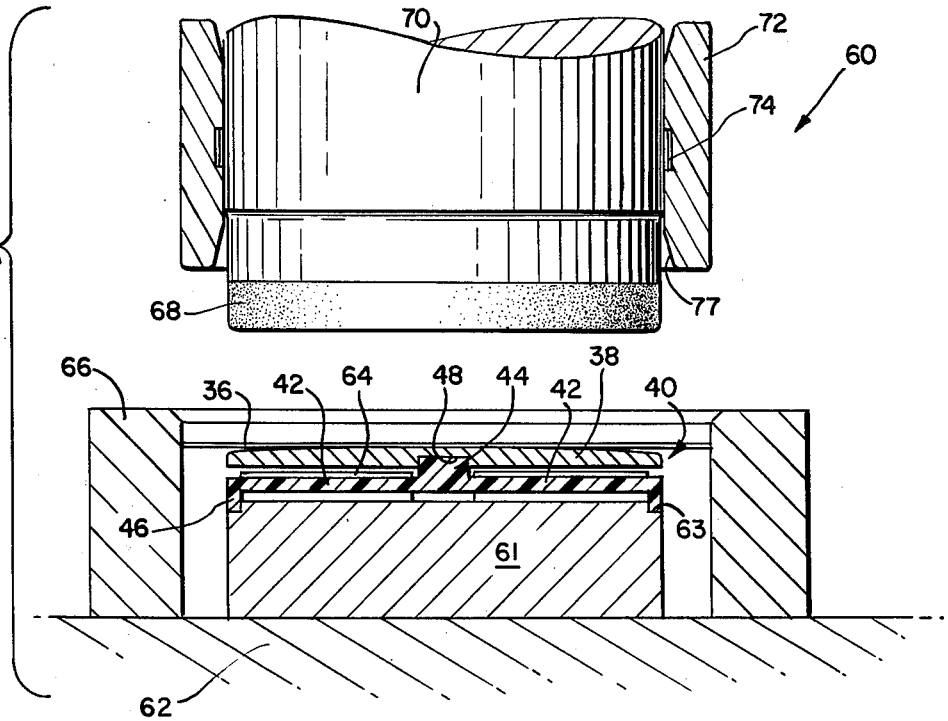
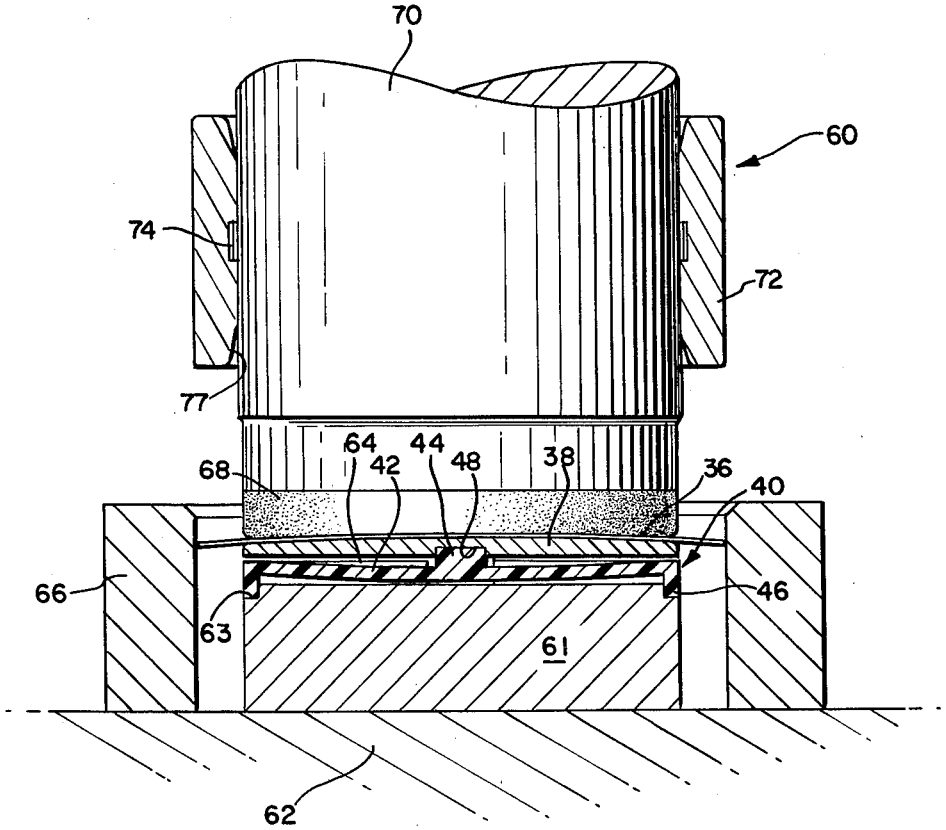
FIG. 4B

SONIC TRANSDUCER HAVING DIAPHRAGM TENSIONING SPRING DIRECTLY ATTACHED TO DIAPHRAGM

BACKGROUND OF THE INVENTION

1. Field of the Invention

The present invention relates to an electroacoustical transducer assembly in general, and to a method and apparatus for mounting the vibratile diaphragm and the diaphragm tensioning spring in such a transducer, in particular.

2. Description of the Prior Art

Capacitance-type electroacoustical transducers are well known in the prior art. In such transducers, a diaphragm having an insulative layer and an electrically conductive surface has its insulative layer in contact with a grooved, irregular, electrically conductive surface of a substantially inflexible disc or backplate. The periphery of the diaphragm is maintained in a fixed position with respect to a transducer housing and a force from a spring member urges said backplate into tensioning engagement with said diaphragm. The insulative layer, the electrically conductive surface of said diaphragm constituting a first electrode, and the conductive surface of said backplate constituting a second electrode, form a capacitor such that when a dc bias voltage is applied across said electrodes, irregularities in said backplate surface set up localized concentrated electric fields in said insulative layer. When an ac signal is superimposed on said dc bias, the diaphragm is stressed such that oscillatory formations develop causing an acoustical wave front to be propagated from said diaphragm. A received acoustical wave front impinging on the diaphragm produces a variable voltage across said capacitor electrodes.

An extremely important design consideration for the above-described transducer is the amount of tension in the transducer diaphragm. In addition to such factors as resonant frequency and signal output magnitude, diaphragm tension also affects transducer sensitivity in at least two additional ways. Within limits, less diaphragm tension provides greater reception sensitivity. Also, excessive diaphragm tension may introduce stress patterns into the diaphragm which may affect the ability of the diaphragm to uniformly contact its associated backplate surface.

Prior art electroacoustical transducers have the periphery of their vibratile diaphragms clamped to a housing member or other such support structure after a predetermined amount of diaphragm tensioning force has been applied. A housing or support structure of this type necessarily increases the size of an electroacoustical transducer, primarily transducer diameter. Furthermore, as the overall size of a conventional capacitance-type transducer is reduced, the transducer housing or the structure that peripherally clamps the transducer diaphragm will consume a larger percentage of the overall transducer diameter. In addition to the increased cost of a physically larger transducer, additional space must be provided to contain the additional size, space that is often at a premium, especially in relatively light weight portable apparatus such as a photographic camera.

SUMMARY OF THE INVENTION

In accordance with the teachings of the present invention, a method and apparatus are provided for significantly reducing the size and cost of an electroacoustical transducer without reducing the acoustical energy transmitting/receiving diaphragm portion of the transducer as a percentage of overall transducer width. The transducer assembly includes a backplate having an electrically conductive major surface and a spring whose center portion supports the center portion of said backplate. The assembly additionally includes a vibratile diaphragm having electrically conductive and electrically nonconductive surfaces on opposite sides thereof. The electrically nonconductive diaphragm surface cooperatively engages said major backplate surface and a peripheral portion of said nonconductive diaphragm surface is fixedly attached to a peripheral extension of said spring while said center portion of said spring engages said backplate and while said spring is being compressed a predetermined amount by a spring-flexing force.

BRIEF DESCRIPTION OF THE DRAWINGS

FIG. 4A is an elevational view of a transducer diaphragm backplate, spring and assembly tool positioned for subsequent diaphragm-to-spring member assembly.

FIG. 4B is an elevational view showing the assembly tool of FIG. 4A compressing portions of the spring of said FIG. 4A to a predetermined height.

DESCRIPTION OF THE PREFERRED EMBODIMENTS

Figure 1A:
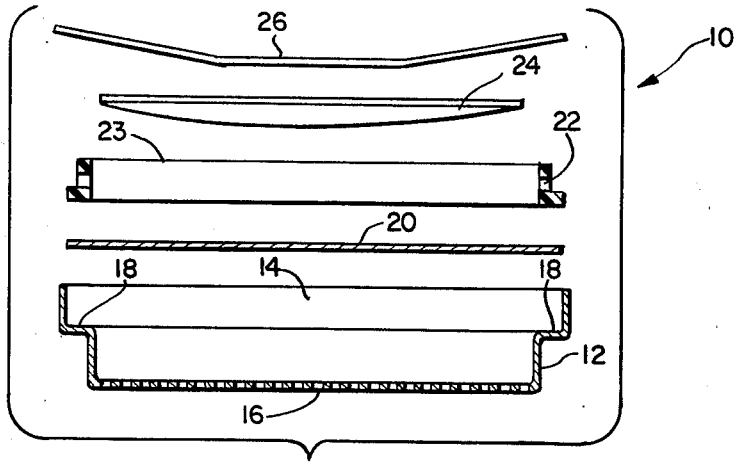
FIG. 1A (PRIOR ART)
FIG. 1A is an exploded elevational view, partly in section, of an electroacoustical transducer constructed in accordance with the prior art.

Referring now to the drawings and specifically to FIG. 1A, an electroacoustical transducer 10 constructed with the teachings of the prior art is depicted. Transducer 10 includes cylindrical housing 12 having open end 14 at one end thereof and partially closed perforated end 16 at the other. Housing 12 also includes flanged portion 18 near open end 14 of said housing 12. Flat vibratile diaphragm 20 extends across opening 14 and is positioned between diaphragm support ring 22 and said housing 12. Diaphragm support ring 22 is of circular cross section with an opening 23 through the center thereof and has a flanged end for cooperative engagement with flange portion 18 of housing 12. Backplate 24, of circular cross section, includes a crowned electrically conductive surface for cooperative engagement with diaphragm 20. Leaf spring 26 provides the force that maintains backplate 24 in proper cooperative engagement with diaphragm 20. When assembled, the transducer components described in FIG. 1A are in the position shown in FIG. 1B.

Figure 1B:
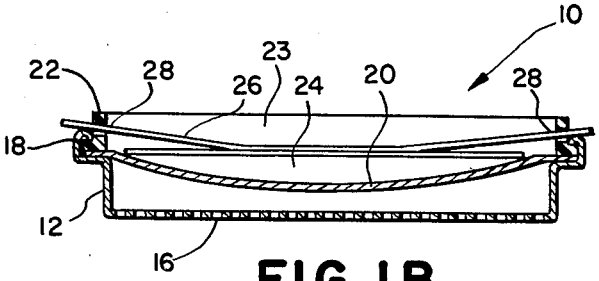
FIG. 1B (PRIOR ART)
FIG. 1B is an elevational view, partly in section, of the transducer of FIG. 1A, fully assembled.

The transducer of FIG. 1B is assembled by placing a light uniform radial force on diaphragm 20 for the purpose of temporarily maintaining said diaphragm in a relatively flat plane and then positioning said diaphragm over opening 14 (FIG. 1) of housing 12. Diaphragm 20 is then "dished" or formed into the shape of a subsequently mating backplate member. The periphery of said diaphragm 20 is then sandwiched between the flanged end of ring 22 and flanged portion 18 of housing 12, and then the open end of housing 12 is clamped onto said ring 22 which places the periphery of diaphragm 20 in a fixed position with respect to said housing 12. Crowned backplate 24 is placed in opening 23 of support ring 22 such that the crowned surface of said backplate 24 engages diaphragm 20 which has already been "dished" or placed into the same shape as the crowned surface of said backplate 24. With backplate 24 so positioned, leaf spring 26 is inserted through opening 28 in support ring 22 such that the center portion of leaf spring 26 presses against backplate 24 and the ends of leaf spring 26 rest against the walls in opening 28 of support ring 22. With leaf spring 26 so positioned, diaphragm 20 will be in proper cooperative engagement with the crowned surface of backplate 24.

Figure 1C:
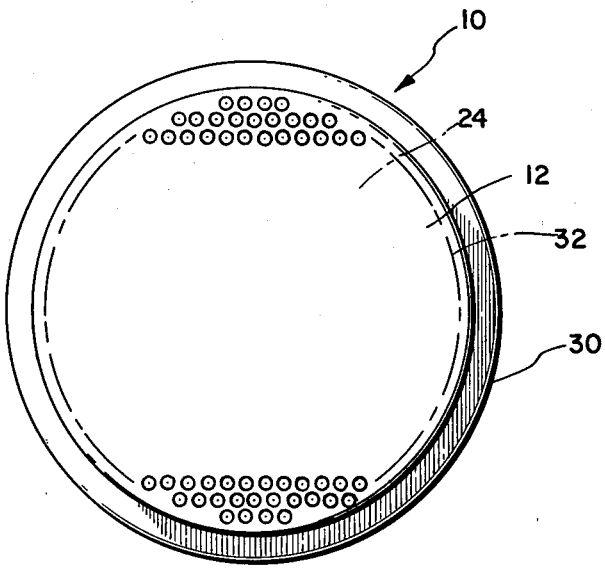
FIG. 1C (PRIOR ART)
FIG. 1C is a bottom view of the perforated transducer housing of FIGS. 1A and 1B.

Constructing an electroacoustical transducer in the manner described above and illustrated in FIGS. 1A and 1B results in a transducer with a relatively large overall diameter. As shown in FIG. 1C, housing 12 of transducer 10 extends to peripheral edge 30 which is well beyond peripheral edge 32 of backplate 24. This increased transducer 10 diameter resulting from the presence of housing 12 very often requires additional space that may increase the size of the device in which it is to be utilized. This increased larger size will also increase transducer 10 material and/or manufacturing costs.

Figure 2A:
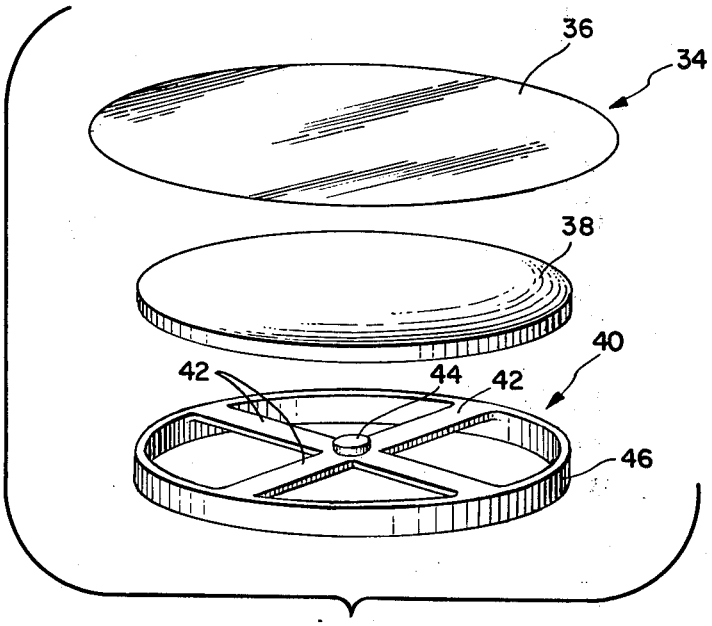
FIG. 2A is an exploded perspective view, in elevation, of an electroacoustical transducer constructed in accordance with the present invention.

Turning now to FIG. 2A, an exploded perspective view of electroacoustical transducer 34 contructed in accordance with the present invention is depicted. Transducer 34 includes circular vibratile diaphragm 36 that is made from a polyimide film sold by the E. I. duPont deNemours and Company, Inc. under its registered trademark KAPTON. One surface of diaphragm 36 is electrically conductive in that it is coated with a thin layer of gold or some other conductive metal and the other surface is the electrically nonconductive KAPTON. Transducer 34 additionally includes circular backplate 38 having a plurality of concentric grooves on the crowned upper surface thereof, said backplate being fabricated from electrically conductive aluminum. Transducer 34 also includes spring member 40 which may be made of metal but in this, the preferred embodiment, is of molded plastic construction. Spring member 40 is in the form of a wheel having four coplanar flat and flexible spokes or prongs, of rectangular cross section, with the inner ends of said prongs joining at hub or boss portion 44 and with the outer portion of said prongs 42 being circumferentially spaced approximately ninety degrees from one another around the periphery of, and terminating in rim or ring 46. Ring 46 is circular and preferably has the same diameter as backplate 38.

Figure 2B:
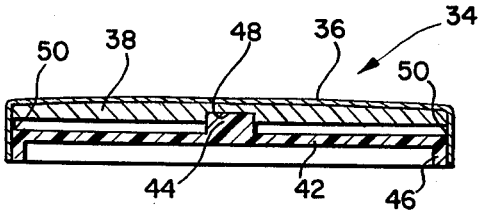
FIG. 2B is a sectional view, in elevation, of the transducer of FIG. 2A, fully assembled.

FIG. 2B is a sectional view, in elevation, of the transducer components illustrated in FIG. 2A, fully assembled. A special assembly tool is employed to assemble transducer 34 into the configuration shown in FIGS. 2B and 2C and said assembly tool will be described below in detail. For the present, however, and with reference to FIGS. 2B and 2C, it should be noted that backplate 38 includes cylindrical recess 48 of circular cross section at the center of backplate 38 having a slightly larger diameter than that of boss 44 at the center of spring member 40, on the side opposite the crowned and grooved side of said backplate 38. Hub or boss 44 of spring member 40 is inserted into recess 48 in and is automatically centered on backplate 38 and then the nonconductive (KAPTON) surface of diaphragm 36 is placed in contact with the grooved and crowned surface of backplate 38. With boss 44 of spring member 40 temporarily maintaining the outer portions of prongs 42 of spring member 40 in a spaced relation from backplate 38, ring 46 together with the outer portions of flexible prongs 42 are compressed or moved a predetermined distance toward the periphery of backplate 38 by means of the above-mentioned assembly tool. With ring 46 and the outer portions of flexible prongs 42 maintained in said compressed condition, peripheral portion 50 of the electrically nonconductive (KAPTON) surface of vibratile diaphragm 36 is adhesively bonded to the peripheral outer surface of circular ring 46. Once the diaphragm 36-to-spring member 40 bonding is complete, the forces stored in flexed prongs 42 will thereafter properly tension said diaphragm 36.

Figure 2C:
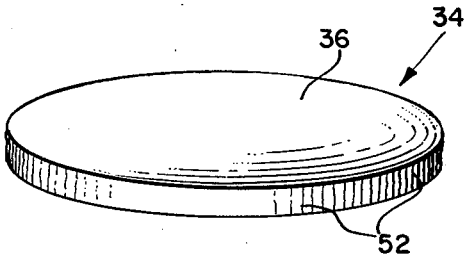
FIG. 2C is a perspective view of the transducer diaphragm of FIGS. 2A and 2B showing said diaphragm peripherally attached to the transducer spring in accordance with the present invention.

Bonding peripheral portion 50 of diaphragm 36 to the curved outer surface of ring 46 necessarily causes gathering 52 of said diaphragm 36 at said peripheral diaphragm portion 50 as shown in FIG. 2C. However, this gathering 52 of diaphragm peripheral portion 50 does not interfere with the ability to more than adequately bond diaphragm 36 to spring member 40.

Figure 3:
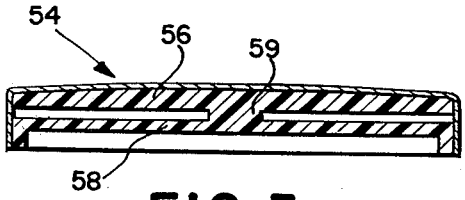
FIG. 3 is a sectional view, in elevation, of an alternate embodiment of the backplate and spring member shown, for example, in FIG. 2B.

Backplate 38 and spring member 40 have been described above as two separate members that mechanically cooperate with one another to form a backplate/-spring member combination. The function provided by this combination can also be provided in a transducer such as in FIG. 3 where transducer 54 includes backplate 56 and spring member 58 that are portions of a single injection-molded member. Instead of having the backplate and spring member coupled together with a backplate recess and a spring member boss as in transducer 34, backplate 56 and spring member 58 are molded to one another at neck 59 during an injection molding process. Part or all of this combination would be subsequently plated with metals such as nickel, chromium or zinc.

Figure 4C:
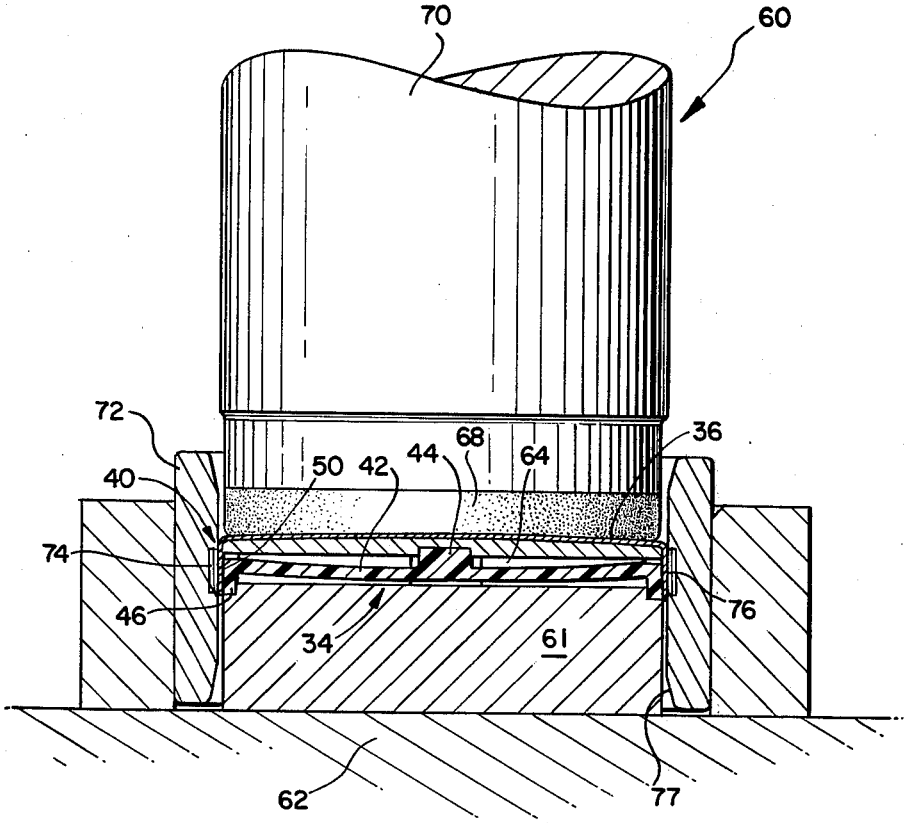
FIG. 4C is an elevational view showing the assembly tool of FIGS. 4A and 4B thermally bonding the diaphragm periphery to a peripheral portion of the transducer spring.

The transducer assembly tool mentioned above for assembling transducer 34, for example, is shown in FIGS. 4A, 4B and 4C, at various stages of transducer 34 assembly. With reference to FIG. 4A, assembly tool 60 is shown in its first stage of assembling transducer 34, the transducer that was previously described with respect to FIGS. 2A, 2B and 2C. Assembly tool 60 includes spring member support 61 mounted on support base 62 that, in turn, includes a nest at the upper end thereof for receiving spring member 40. The nest includes circular shoulder 63 around the top outer edge of cylindrical support member 61 and four spaced-apart, gap setting fingers 64 that project upward from said support member 61. The nest at the top of support member 61 prevents lateral movement of spring member 40 while it is positioned on said and at the same time permits vertical flexing of the center portion of said spring member 40 including prongs 42 when positioned on said nest of support member 61.

Spring member 40 is placed into said nest of support member 61 such that hub 44 projects upward and such that said gap setting fingers 64 extend a predetermined distance through the spaces between adjacent flexible prongs 42. Backplate 38 is placed on top of spring member 40 such that recess 48 in backplate 38 cooperatively engages boss 44 projecting upwardly from spring member 40, thereby laterally centering said backplate 38 over said spring member 40. Circular diaphragm 36 is then placed within centering guide 66 with its non-conductive surface adjacent the crowned and grooved surface of backplate 38. Poised above diaphragm 36 in FIG. 4A is urethane cushioning pad 68 attached to and supported by transducer compression rod 70. Slidably attached to rod 70 is diaphragm-forming collar 72 that includes electrically heated heating element 74. Force producing means (not shown) are coupled to said transducer compression rod 70.

The next stage of transducer 34 assembly is shown in FIG. 4B. In FIG. 4B, rod 70 has been moved downward to such an extent that cushioning pad 68 presses on diaphragm 36 and said diaphragm 36 is placed in intimate contact with backplate 38. In addition, with the center portion of backplate 38 resting on boss 44 of spring member 40 and with ring 46 of spring member 40 resting on shoulder 63 in the nest portion of support member 61, the inner portions of prongs 42 of spring member 40 are flexed downward as urethane pad 68 is moved downward by rod 70 until backplate 38 engages gap setting fingers 64, the engagement of said fingers 64 with said backplate 38 establishing the proper amount of flexing of prongs 42 of spring member 40 for the subsequent proper tensioning of vibratile diaphragm 36.

The third and final stage of transducer 34 assembly by assembly tool 60 is shown in FIG. 4C. In FIG. 4C, cylindrical collar 72 together with heating element 74 mounted thereon is moved downward by force producing means (not shown) until said heating element 64 is in contact with peripheral portion 76 of the outer or electrically conductive surface of vibratile diaphragm 36. Tapered inner surface 77 of collar 72 as well as portions of the inner cylindrical surface of said collar 72 bend the periphery of diaphragm 36 over the outer edge of ring 46 and into contact with the outer curved surface of said ring 46 as said collar 72 is moved downward by said force producing means. The inner or non-conductive surface or peripheral portion 50 of diaphragm 36 has a thermally activated adhesive applied thereto. Heat is then applied to the peripheral portion of diaphragm 36 and to said adhesive by heating element 64 thereby bonding the inner surface of said peripheral diaphragm portion 50 to the outer curved surface of spring member ring 46. Collar 72 and rod are subsequently raised and then fully assembled transducer 34, together with its properly tensioned diaphragm 36, are then removed from transducer assembly tool 60.

DISCUSSION

Backplate 38 in transducer 34 of the present invention and backplate 24 in, for example, prior art transducer 10 are identical in construction. However, the diameter of prior art transducer 10 is substantially larger than that of said transducer 34. This larger transducer diameter is primarily due to the presence of housing 12 in transducer 10, structure or the equivalent thereof that is not present in transducer 34 of the present invention. Instead of coupling the force produced by the diaphragm tensioning spring to the diaphragm to be tensioned through intermediate structure such as housing 12 in prior art transducer 10, the diaphragm tensioning spring of the present invention (spring member 40) is directly attached (adhesively bonded) to the diaphragm to be tensioned, making such intermediate structure unnecessary. Constructing a transducer in this manner will result in a substantially smaller transducer that can be produced at significantly less cost, a transducer that is very attractive to the equipment designer employing such a device where space is a premium. Furthermore, as the overall size of a transducer constructed in accordance with the present invention is reduced, there will be no support structure, such as housing 12 in prior art transducer 10, to reduce that portion of the transducer that transmits/receives acoustical energy.

Transducer 34 of the present invention can be coupled to an external electrical circuit in any number of possible ways. One of the most obvious ways would be with one or more electrically conductive flexible fingers that would frictionally grip the electrically conductive and gathered edge of the diaphragm, and the electrically conductive backplate. Another way to externally connect the transducer of the present invention would be to fuse an electrical conductor to the transducer backplate and/or diaphragm.

The thermally activated adhesive mentioned above employed to bond transducer diaphragm 36 to ring 46 of spring member 40 may be applied in at least two ways. The first way would be to place a liquid adhesive on either diaphragm 36 or the outer surface of ring 46 and then let the adhesive dry before transducer 34 is assembled. The second way would be to apply a liquid adhesive to either of these two members during the assembly process. In either case, heat would subsequently be applied to the thermally activated adhesive.

It will be apparent to those skilled in the art from the foregoing description of my invention that various improvements and modifications can be made in it without departing from its true scope. The embodiments described herein are merely illustrative and should not be viewed as the only embodiments that might encompass my invention.

What is claimed is:

1. An electroacoustical transducer assembly comprising a backplate having opposed major surfaces, a thin diaphragm having opposed electrically conductive and nonconductive surfaces, said diaphragm extending across one major surface and around the perimeter of said backplate with its non-conducting surface in adjoining relation to said backplate, and a spring member positioned in engagement with the other surface of said backplate, said spring member having a peripheral portion directly affixed to said diaphragm so as to urge said one major surface of said backplate into engagement with said diaphragm.

2. The transducer of claim 1 wherein said peripheral portion of said spring is a generally circular shape.

3. The transducer of claim 2 wherein said backplate and spring include cooperating portions configured for centrally aligning of each with the other.

4. The transducer of claim 3, wherein said backplate and said spring member cooperating portions include a recess at the center of one of said major surfaces of said backplate and a raised portion at the center of said spring and said raised spring member portion cooperatively engages said backplate recess.

5. The transducer of claims 1, 2 or 3 wherein said periphery of said diaphragm is adhesively affixed to said peripheral portion of said spring.

6. An electroacoustical transducer assembly, comprising:

a flexible spring member having inner and outer portions;

a relatively inflexible backplate member having an electrically conductive major surface and an opposed surface; and a relatively flexible diaphragm having electrically conductive and electrically nonconductive surfaces on opposite sides thereof, the center portion of the nonconductive surface of said diaphragm cooperatively engaging said conductive major surface and peripheral portions of said diaphragm being fixedly attached to said spring member outer portion, said spring member being flexed a predetermined amount prior to being so fixedly attached, to thereby provide the force necessary to properly tension said diaphragm and to maintain the said nonconductive surface of said diaphragm in proper cooperative engagement with the said conductive surface of said backplate.

7. The apparatus of claim 6 wherein said spring member is compressed toward said backplate.

8. The apparatus of claim 6 wherein said spring member includes a raised portion projecting from the center of its said inner portion and said backplate includes a recess at the center of said opposed surface, said raised spring portion and said backplate recess cooperatively engaging one another to thereby center said spring member and said backplate with respect to one another.

9. The apparatus of claim 8 wherein said backplate recess has a cylindrical shape and wherein said raised portion of said spring member also has a cylindrical shape.

10. The apparatus of claim 9 wherein both of said cylindrical shapes are circular in cross section.

11. The apparatus of claim 9 wherein said backplate is circular and said cylindrical recess is at the geometrical center of said circular backplate.

12. An electroacoustical transducer assembly, comprising:

a relatively inflexible backplate member having an electrically conductive major surface and having a spring portion projecting therefrom; and a pliant, relatively inelastic vibratile diaphragm having electrically conductive and electrically nonconductive surfaces on opposite sides thereof, the center portion of the nonconductive surface of said diaphragm cooperatively engaging said backplate surface and peripheral portions of said diaphragm being fixedly attached to peripheral portions of said flexible spring, said spring being flexed a predetermined amount prior to being so fixedly attached to thereby provide the force necessary to properly tension said diaphragm and to maintain the said nonconductive surface of said diaphragm in proper cooperative engagement with the said conductive surface of said backplate.

13. The apparatus of claims 6 or 12 wherein said peripheral portions of said diaphragm and said outer portion of said spring member are fixedly attached to one another with an adhesive.

14. The apparatus of claims 6 or 12 wherein said diaphragm is circular and wherein said peripheral portion of said flexible spring terminates in a circular ring.

15. A method of assembling an electroacoustical transducer of the type having a backplate with an electrically conductive major surface, a vibratile diaphragm with electrically conductive and electrically nonconductive surfaces on opposite sides thereof and a flexible spring having inner and outer portions, comprising the steps of:

mounting the outer portion of said flexible spring on a support such that the inner portion can be flexed toward said support;

mounting said backplate on said spring with the side of said backplate opposite said major surface in engagement with said inner portion of said flexible spring;

placing said vibratile diaphragm on said backplate such that the nonconductive surface of said diaphragm contacts said major surface;

flexing said flexible spring such that the said outer portion of said spring moves a predetermined distance toward said backplate; and fixedly attaching portions of the periphery of said diaphragm to said outer portion of said spring while said spring is so flexed.

16. The method of claim 15, wherein the periphery of said diaphragm is wiped around the outer backplate edge before said peripheral diaphragm portions are fixedly attached to said outer portions of said spring.

17. The method of claim 15 wherein said spring is flexed by pressure on said backplate directed toward said spring support.

* * * * *